US005946798A

United States Patent [19]

Buluschek

[11] Patent Number: 5,946,798

[45] Date of Patent: Sep. 7, 1999

[54] METHOD FOR MANUFACTURING COAXIAL CABLES

[75] Inventor: Bruno Buluschek, Echandens, Switzerland

[73] Assignee: E. Kertscher S.A., Yvonand, Switzerland

[21] Appl. No.: 08/818,977

[22] Filed: Mar. 14, 1997

[30] Foreign Application Priority Data

Mar. 21, 1996 [FR] France ..... 96 03526

[51] Int. Cl.[6] ..... H01B 13/20

[52] U.S. Cl. ..... 29/828; 29/728; 174/36; 174/107

[58] Field of Search ..... 29/828, 728; 174/36, 174/107

[56] References Cited

U.S. PATENT DOCUMENTS

| | | | |
|---|---|---|---|
| 2,908,314 | 10/1959 | Loucks | 29/728 |
| 3,356,790 | 12/1967 | Polizzano et al. | 29/828 X |
| 3,397,442 | 8/1968 | McGean | 29/728 X |
| 3,553,811 | 1/1971 | Garner | 29/828 X |
| 3,633,261 | 1/1972 | Grabe | 29/728 X |
| 3,662,090 | 5/1972 | Grey | 174/107 |
| 3,693,250 | 9/1972 | Brorein et al. | 29/728 X |
| 3,710,440 | 1/1973 | Nevin et al. | 29/828 |
| 3,717,719 | 2/1973 | Smith et al. | 174/107 |
| 3,874,076 | 4/1975 | Tsukamoto et al. | 28/828 |
| 4,083,484 | 4/1978 | Polizzano et al. | 29/828 X |
| 4,560,829 | 12/1985 | Reed et al. | 29/828 X |
| 5,212,350 | 5/1993 | Gebs | 174/36 X |
| 5,379,693 | 1/1995 | Hoffmann et al. | 101/375 |
| 5,500,488 | 3/1996 | Buckel | 174/36 X |
| 5,515,603 | 5/1996 | Ziemek et al. | 29/828 |
| 5,543,000 | 8/1996 | Lique | 156/52 |

FOREIGN PATENT DOCUMENTS

| | | |
|---|---|---|
| 1 261 740 | 9/1961 | Germany . |
| 1 465 625 | 5/1969 | Germany . |
| 96/42030 | 12/1996 | WIPO . |
| 97/45843 | 12/1997 | WIPO . |

*Primary Examiner*—Joseph J. Hail, III
*Assistant Examiner*—William Hong
*Attorney, Agent, or Firm*—Griffin, Butler, Whisenhunt & Szipl, LLP

[57] ABSTRACT

The method for manufacturing a core comprises the following steps: providing a strip made of an electrically conductive material, shaping the strip into a tube, the two edges of the strip being substantially in contact, and welding together the two edges of the tube-shaped strip, via laser welding, in order to form the core (1). The method is preferably performed continuously using a continuous strip of substantial length, in an advantageous manner, the shaped and welded tube undergoes calibration, then a surface treatment intended to promote the adhesion of the insulating material (6) so as to insulate the core with respect to the external conductor (8) of the coaxial cable.

16 Claims, 3 Drawing Sheets

METHOD FOR MANUFACTURING COAXIAL CABLES

Figure 1:
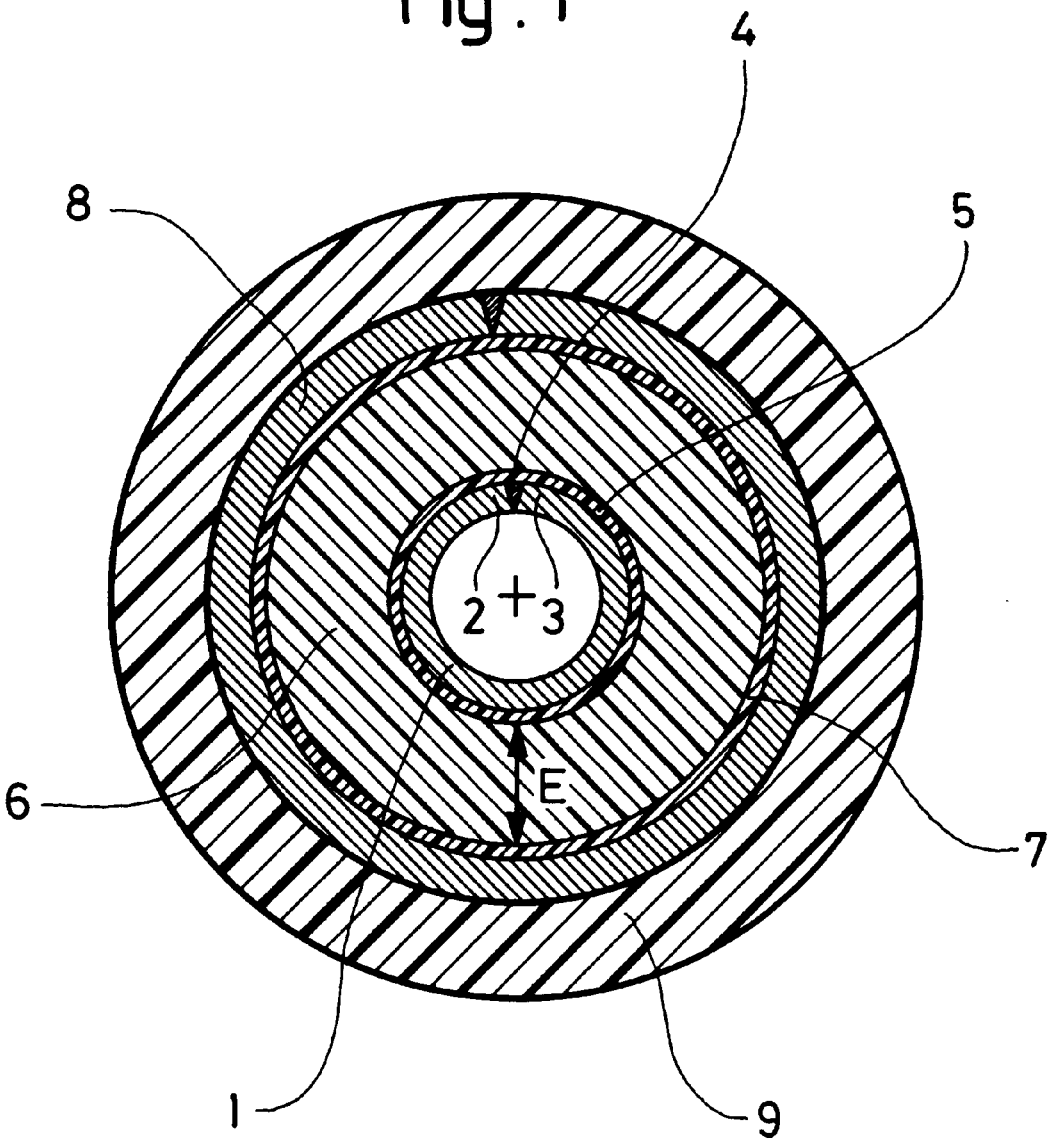
Figure 2A:
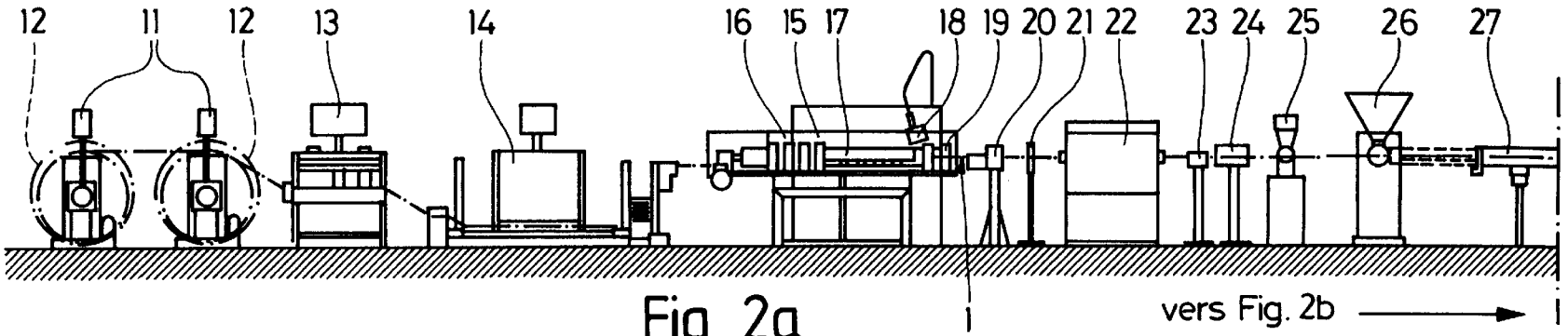
Figure 3A:
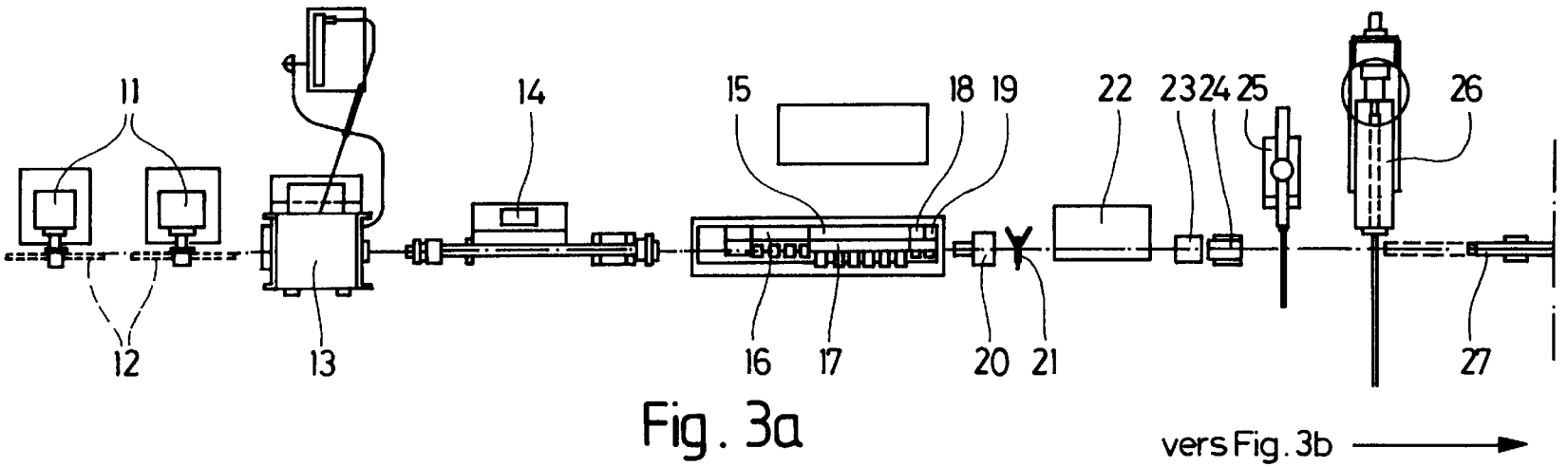
Figure 2B:
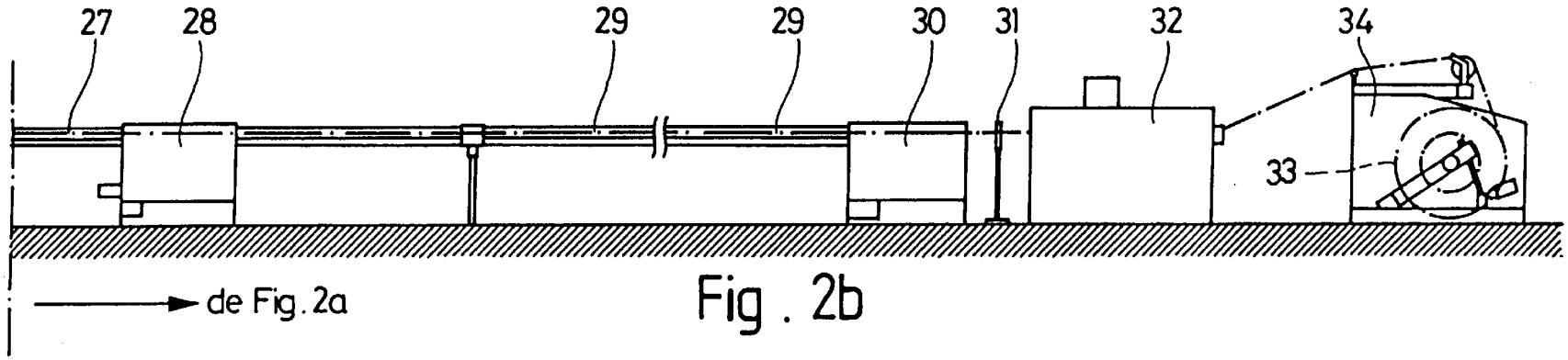
Figure 3B:
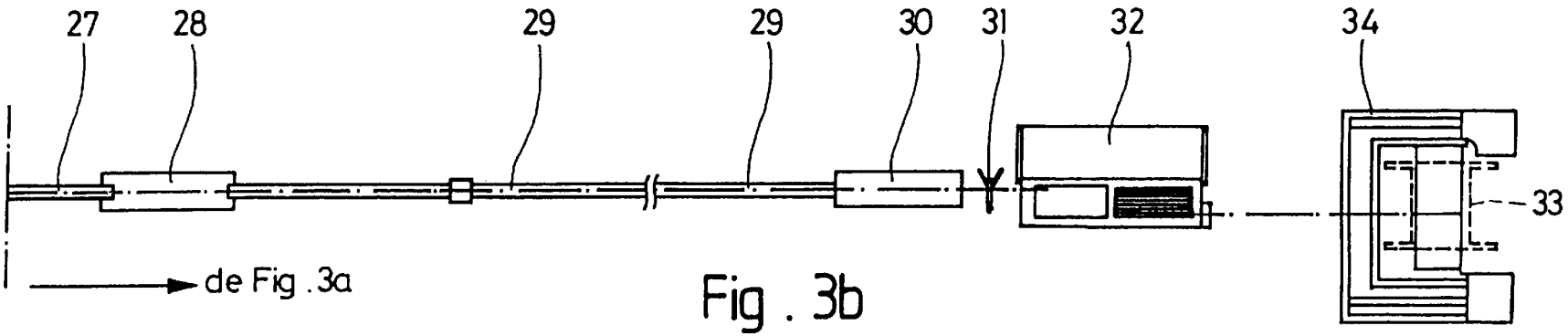

The present invention concerns a method for manufacturing coaxial cables, and more precisely a method for manufacturing an inner conductor or core for coaxial cables.

Coaxial cables have been replaced by fibreoptics in the field of long distance transmissions, but their use in numerous other fields is constantly increasing.

Coaxial cables which are used in particular for data transmission, generally comprise an inner conductor covered with a layer of dielectric material, a foam-like polymer, the external surface of the dielectric being covered with an outer conductive layer or conductor, which may be made from a welded metal strip, said outer layer being covered with a film of insulating material.

The present invention results from research made with a view to reducing the cost price of the inner conductor.

The use of a full copper wire core has been minimized for various reasons, and in particular because of the high price of this metal.

In practice a full copper wire core is only used for cores of small diameter, namely less than 2 mm.

For cores having diameters of between approximately 2 mm and 5 mm, these are generally made from a solid aluminium wire onto which a layer or coating of copper is deposited.

This way of obtaining the core has the disadvantage that the method for depositing the copper coating on the aluminium wire is complex and costly.

Finally, for cores having diameters greater than 5 mm, the current solution consists of using copper tubes.

The copper tubes are obtained by drawing bars of copper. However, their price is relatively high because of the complexity of the method for obtaining them. On the other hand, they are delivered in relatively short lengths, as a result of their manufacturing method and the space requirement of reels loaded with tubes. It is thus necessary, during manufacture of coaxial cables, to carry out end-to-end connections which require great care in order not to reduce the electric performance of the coaxial cable thus obtained. Moreover, the use of copper tubes renders the cores obtained according to this method heavy and not very flexible, this being due to the relatively significant thickness of the walls of the tubes, this thickness being prescribed by the mechanical stresses which the tubes have to endure during their manufacture.

An aim of the present invention is to provide a method for manufacturing coaxial cable cores which is less complex than current techniques, and allows lower cost prices to be obtained.

In order to achieve this result, the invention provides a method for manufacturing a core for a coaxial cable having a tubular core, at least the external surface of which is made of copper or another conductive material, an electrically insulating layer surrounding the core, and an outer conductor covering the insulating layer and electrically insulated with respect to the core, such method being characterised in that it comprises the following steps:

- providing a strip in an electrically conductive material
- shaping the strip in a tube, the two edges of the strip being substantially in contact, and
- welding together the two edges of the tube-shaped strip, by laser welding.

Thus the use of techniques for shaping tubes from a strip of an electrically conductive material allows tubular cores, whose thickness is relatively small with respect to the tube diameter in comparison with tubular cores of the same diameter obtained by drawing according to the prior art, to be obtained without excessive difficulty. By way of example, according to the invention it is possible to make cores having wall thicknesses as small as 0.2 mm for a diameter of the order of tens of millimetre. Amongst other advantages, the method according to the invention consequently allows lighter, more flexible and less expensive cores to be made than those made according to techniques of the prior art.

The use of a strip also allows end-to-end connection of two consecutive strips by simple line welding, which facilitates the production of the continuous core.

Preferably, after the welding step, the method comprises a step for calibrating the obtained core, during which the tube is given a section of perfectly circular external contour.

Calibration thus allows a core of cylindrical external contour to be obtained, which, during the final manufacturing steps of the coaxial cable, allows insulating layer thicknesses which are certain to have the minimum required value to be obtained.

Again preferably, after the core calibrating step, the method comprises a tube external surface treating step intended to promote adhesion of said electrically insulating layer.

Providing a treating step for the external surface of the core after calibration thereof allows one to ensure constant adhesion of the insulating material over the entire surface, without risk of detachment or the formation of bubbles, which guarantees the high quality of the finished product.

Treatment of the external surface may include chemical treatment, via passing the tube through a receptacle filled with a suitable bath. It is more advantageous for this step to comprise coating the external surface with an adhesion promoter, such coating being, according to an advantageous embodiment, achieved via passing the tube through a receptacle containing said product in a viscuous state.

The method according to the invention further comprises coating the previously formed core with a layer of insulating material, such layer possibly being provided with a protective skin.

In an advantageous manner, the insulating material is a foam, and the coating is achieved via passing the tube in a receptacle containing the foam being formed.

When the method comprises the step which has just been described, an intermediate product is obtained in the manufacturing of the coaxial cable. This product may be completed to form a coaxial cable with the aid of other installations. It bears manipulations particularly well when the layer of insulating material is covered with a protective skin.

One can also envisage going further in the manufacturing of the coaxial cable, and providing that the method further comprises a step for applying an external conductor which surrounds the layer of insulating material to form a coaxial cable.

In an advantageous manner, the external conductor application step itself comprises the following steps:

- providing an additional strip of conductive material.
- shaping such strip in a tube surrounding said core which is covered in said insulating material, possibly provided with a protective skin,
- welding together the two edges of the additional tube-shaped strip, by laser welding, and
- possibly then coating the second tube-shaped welded core with a protective covering or jacket.

One has thus manufactured a complete coaxial cable.

The method which has just been described may, of course, be performed discontinuously, by manufacturing successive lengths of coaxial cable, however, it is preferable for it to be performed continuously using a continuous strip of substantial length to form the core, the tube being formed being driven through a shaping and welding station via driving means arranged after the shaping and welding station, these driving means being arranged after a calibrating station if there is a calibration operation, and before a surface treatement station, if such treatment is provided.

This manner of operating allows the core being formed to be kept under tension during shaping and calibration, which procures better quality, and also prevents the layer which has undergone surface treatment from being damaged by the driving means, which could adversely affect the adhesion of the insulating material.

The method of the invention will be described in more detail with the aid of a practical example illustrated by the drawings, in which:

FIG. 1 is a transversal section of an example of coaxial cable obtained according to the method of the invention, and FIGS. 2*a*, 2*b* and 3*a*, 3*b* are elevation and top views of an installation implementing the method of the invention for the production of an intermediate product consisting of a core coated with a layer of insulating material. The manufacturing steps for completing the coaxial cable, which are known, are not shown.

The coaxial cable shown in FIG. 1 comprises a core 1, which here is made of copper, but which could be made of steel externally coated with copper, of aluminium, of aluminium externally coated with copper or suchlike.

It will be noted in this regard that it is the electric conductivity of the external surface of the core which is preponderant in the transport of high frequency signals via the coaxial cables and when a copper coated metal strip is used, the side of the strip coated with copper is situated on the outside of the core.

The external contour of the section of core 1 is perfectly circular, but such section shows that it has been obtained from a continuous strip, made of an electrically conductive material, bent to have the shape of a closed curve in section, edges 2 and 3 being joined. A zone 4, which has been laser melted assures the join between edges 2 and 3. It will be noted here that it is well known that a zone melted in this manner has a different metallographic structure to that of the non-melted parts, and it can thus easily be discerned by the man skilled in the art.

On the external surface of the core there is a layer of adhesion promoter 5, of substantially constant thickness, and which is actually of the order of 0.04 to 0.08 mm, with slight eccentricity.

The core coated with adhesion promoter 5 is surrounded by a continuous and relatively thick layer of insulating material, consisting here of polyethylene foam.

The insulating layer 6 is itself coated with a thin protective skin 7, which is in contact with an external conductor 8, formed, like core 1, from an aluminium strip, from copper coated aluminium, or from a copper strip bent to have the shape of a closed curve in section and laser welded.

A difference will, however, be noted between the core and the external conductor: for the external conductor, it is the internal surface which must comply with strict cylindricity and eccentricity conditions, at least over the majority of its periphery, while the shape of its external surface is of less importance.

The radial thickness E of the insulating layer must preferably be the most constant possible over the majority of the cable periphery, such thickness being able to be greater locally, but never less, than value E.

A protective envelope or jacket 9, made of a suitable plastic material, surrounds and protects external conductor 8.

FIGS. 2*a*, 2*b* and 3*a*, 3*b* relate to an installation provided to operate continuously, the products moving from the left towards the right in these two figures.

Pay-out reels 11 are each intended to carry a coil 12 of metal strip made of copper, aluminium, copper-coated aluminium or copper-coated steel, rolled flat.

Reference 13 designates a laser welding station designed to connect successive lengths of strips drawn from one of reels 11. It will be noted here that the connection of two flat strips to each other is much easier than the connection of two tubes.

Reference 14 designates a strip accumulator, intended to prevent jerks or interruptions in the rest of the installation Reference 15 designates the shaping and welding installation.

This installation comprises a series of rollers 16 acting mainly in the vertical direction, followed by a second series of rollers 17 acting in a horizontal or oblique direction, in accordance with a well known technique.

A laser welding station 18 follows these two series of rollers, and it is itself followed by a new series of rollers 19 acting in the vertical direction.

Beyond shaping and welding station 15, a calibrating tool 20 is arranged so as to give the tube an external cylindrical surface having as perfectly circular as possible a section.

Reference 21 designates a gauge intended to monitor the diameter of the tube thereby formed. A driving unit 22 follows the diameter monitoring unit.

Reference 23 designates a welding monitoring device, intended to assure that the welding has been faultlessly performed.

Reference 24 designates a surface conditioner, which may in particular comprise means for brushing the external surface of the tube.

Reference 25 designates an extruder for a thin layer of an adhesion promoter, deposited in a viscuous state. Extruder 25 is itself followed by an extruder 26 which is more significant in volume, and which is intended to extrude the polyethylene foam. This extruder 26 contains, in a conventional manner, polyethylene heating means, and means for mixing the polyethylene with a foam producing gas, in this case nitrogen.

Cooling extruder 26 is immediately followed by a water tank 27 which is intended for the cooling of foam layer 6 and thus for forming skin 7.

A dryer 28 is followed by a cooling tank 29, which is followed by a second dryer 30. After passing through a diameter gauge 31, the product is driven by a second driving device 32 to be wound onto a reel 33 mounted on a winder 34.

In a different installation, reel 33 will be reeled off for the application of the external conductor onto the insulating layer and the finishing of the coaxial cable.

Of course, it would be possible to omit reel 33 and winder 34, and to provide an installation for the application of the external conductor and the protective envelope or jacket directly after the installation which has just been described.

What is claimed is:

1. A method for manufacturing a coaxial cable comprising forming a hollow tubular core inner conductor of the cable, at least one external surface of the core being made of an electrically conductive material, a layer of electrically insulating material surrounding the core, and an external conductor covering the layer of insulating material and electrically insulated with respect to the core, said method comprising the following steps:

providing a strip made of an electrically conductive material, shaping the strip into a tube, the two edges of the strip being substantially in contact, and welding together the two edges of the tube-shaped strip, via laser welding, in order to form the core.

2. A method according to claim 1, wherein, after the welding step, it comprises a step for calibrating the tubular core obtained, during which the latter is given a section of circular external contour.

3. A method according to claim 2, wherein, after the core calibrating step, it comprises a step for treating the external surface of the core so as to promote the adhesion of said electrically insulating layer.

4. A method according to claim 3, wherein, said external surface treatment step comprises coating said surface with a layer of an adhesion promoter.

5. A method according to claim 4, wherein the adhesion promoter coating is achieved by passing the tube through the receptacle containing said adhesion promoter, the latter being in a viscous state.

6. A method according to claim 1, wherein it further comprises coating the previously formed core with a layer of insulating material, such layer being possibly provided with a protective skin.

7. A method according to claim 6, wherein the insulating material is a foam, and wherein the coating is achieved by passing the core in a receptacle containing the foam being formed.

8. A method according to claim 6, wherein it further comprises a step for applying the external conductor which surrounds the layer of insulating material to form the coaxial cable.

9. A method according to claim 8, wherein the external conductor application step comprises the following steps:

providing an additional strip made of a conductive material, shaping the additional strip into a tube surrounding said core which is coated with said insulating material, and welding together the two edges of the additional tube-shaped strip, via laser welding in order to form the external conductor.

10. A method according to claim 9, wherein it further comprises a step for covering the welded tube-shaped external conductor with a protective envelope or jacket.

11. A method according to claim 1, wherein the method is performed continuously using a continuous strip of substantial length to form the core, the tube being formed being driven through a shaping and welding station by driving means which are arranged after said shaping and welding station, such driving means being arranged after a calibrating station if there if there is calibration, and before a surface treatment station, if there is such a treatment.

12. A method according to claim 1, wherein the strip forming the core comprises a copper coated aluminum strip.

13. A coaxial cable comprising a hollow tubular core forming an inner conductor of the cable, at least one external surface of the core being made of an electrically conductive material, a layer of electrically insulating material surrounding the core, and an external conductor covering the layer of insulating material and electrically insulated with respect to the core, wherein said tubular core is formed from a strip made of an electrically conductive material and shaped into a tube, the two edges of the strip being welded together via laser welding.

14. A coaxial cable according to claim 13, wherein said insulating layer is provided with a protective skin.

15. A coaxial cable according to claim 13, wherein said external conductor is formed from an additional strip made of a conductive material and shaped into a tube, the two edges of the additional strip being welded together via laser welding.

16. A coaxial cable according to claim 15, wherein said external conductor is covered by a protective envelope or jacket.

* * * * *